US006118264A

United States Patent [19]

Capici

[11] Patent Number: 6,118,264

[45] Date of Patent: Sep. 12, 2000

[54] BAND-GAP REGULATOR CIRCUIT FOR PRODUCING A VOLTAGE REFERENCE

[75] Inventor: Salvatore Vincenzo Capici, Barrafranca, Italy

[73] Assignee: STMicroelectronics, S.r.l., Agrate Brianza, Italy

[21] Appl. No.: 09/344,309

[22] Filed: Jun. 24, 1999

[30] Foreign Application Priority Data

Jun. 25, 1998 [IT] Italy ..... MI98A1453

[51] Int. Cl.[7] ..... G05F 3/16

[52] U.S. Cl. ..... 323/316; 323/907

[58] Field of Search ..... 323/315, 316, 323/907; 327/539

[56] References Cited

U.S. PATENT DOCUMENTS 5,304,626 4/1994 Pirez et al. ..... 323/315
5,304,918 4/1994 Khieu ..... 323/315

*Primary Examiner*—Shawn Riley
*Attorney, Agent, or Firm*—Theodore E. Galanthay, Esq.; Robert Iannucci, Esq.; Seed IP Law Group, PLLC

[57] ABSTRACT

A band-gap regulator circuit produces a voltage reference having a temperature compensation for second order effects. The regulator circuit includes: a Brokaw cell for producing a first band-gap voltage reference Vbg; a circuit portion including a comparator connected to the Brokaw cell output for providing a compensation voltage value Vcorr; and a summing circuit that sums together the compensation voltage value Vcorr and the first band-gap voltage reference Vbg.

19 Claims, 5 Drawing Sheets

BAND-GAP REGULATOR CIRCUIT FOR PRODUCING A VOLTAGE REFERENCE

TECHNICAL FIELD

The present invention relates to a band-gap regulator circuit to produce a voltage reference having a temperature compensation on second order events.

More specifically, the invention relates to an electronic band-gap voltage regulator comprising at least a Brokaw cell for providing a first band-gap voltage reference.

BACKGROUND OF THE INVENTION

The band-gap voltage reference circuit is well-known to the designers of analog circuits. This reference circuit provides a constant voltage as independent as possible of the environmental temperature at which the circuit operates. This type of circuit is present in many systems manufactured with integrated circuits. For example, a constant voltage reference is required for analog/digital converters. Such converters compare the value of a voltage reference signal against the value of samples to be converted.

Numerous circuit arrangements are known which provide a band-gap voltage reference of the time-continuous type (i.e., of the type which can be used for 100% of the time). One such circuit is disclosed in Gray and Mayer, "Analysis and Design of Analog Integrated Circuits", published by John Wiley & Sons. These circuits are generally manufactured using bipolar junction technology because their operating principle is based on intrinsic properties of bipolar junction transistor (BJT) as described in the above noted publication.

The operating principle of a band-gap voltage reference circuit is based on the compensating increases and decreases in the rate of voltage change due to changes in environmental temperature. That is, the voltage between the base and the emitter of one bipolar transistor decreases with the environmental temperature at the rate of approximately 2 mV/° C.

In the annexed FIG. 1 a band-gap circuit known as Brokaw cell is shown as an example.

Such a Brokaw cell comprises a transistor TI and a transistor T2 of the type pnp connected together in a current mirror configuration. The emitters of the transistors TI and T2 are connected to a reference of a supply voltage Vcc. The bases of the transistors TI, T2 are connected together.

The base and collector of the transistor TI are connected together and to the collector of a transistor T3 of the type npn.

More particularly, the collectors of the transistors TI, T2 are connected to respective collectors of two transistors T3 and T4 having different emitter areas, the emitter area of the transistor T4 being n times greater than the emitter area of the transistor T3. A voltage divider formed by two resistors R1, R2 is connected between the emitter of transistor T4 and the ground with the connection node between the resistances being connected to the emitter of transistor T3.

The band-gap voltage Vbg is taken from the interconnection node between the bases of the two transistors T3 and T4 and it is given by the following relation:

$$Vbg=Vbe+K*VT, \tag{1}$$

where Vbe is the voltage drop between base and emitter, VT is the threshold voltage and K is a design constant having the following value:

$$K=2*\ln(n)*R2/R1. \tag{2}$$

There is a dependency from temperature of the voltage drop Vbe which may be defined as follows:

$$Vbe(T)=Vgo+\alpha*T+f(T^2), \tag{3}$$

where Vgo is the silicon band-gap voltage at zero Kelvin degrees.

If we use the relation (3) inside relation (1) we obtain that:

$$Vbg=Vgo+\alpha*T+f(T^2)+K*VT. \tag{4}$$

Since the variation with temperature of the threshold voltage VT is known and the constant K value may be designed, it's possible to reduce to zero the first order dependence from temperature of the band-gap voltage Vbg.

FIG. 2 shows a diagram of the variations versus temperature of the band-gap voltage Vbg for a known Brokaw cell.

As may be appreciated, on a temperature range from −50 up to 150° C., a 1.5 mV variation of the band-gap voltage may be observed. The gaussian curvature which is reported in FIG. 2 is due just to the second order effects dependence which has been indicated in relation (4).

This variation is in addition to errors due to the manufacturing process spread, to the circuit components mismatch, to mechanical stress during the packaging phase. Therefore, the probability of failing to meet the values provided by the design specifics is high.

As a matter of fact, second order effects must be compensated to comply with the design specifics of the voltage regulator.

The prior art proposes some solutions to meet this requirement. Known prior art solutions are based on the fact that the dependence on temperature of the base-emitter voltage drop may be modified by biasing the transistor with an absolute temperature proportional current (PTAT voltage regulators).

However, those solutions present some drawbacks:

- the corresponding regulator circuits are power consuming when there are many current branches. Moreover, a possible mismatch between the current mirrors reduce the compensation efficiency. See for instance: Gunawan and others: "A Curvature-Corrected Low Voltage Band-gap Reference"—IEEE Journal of Solid State Circuit, vol. 28, No. 6, June 1993.
- known regulators do not work correctly when supplied with voltage values less than 3 V, which are the supply voltage values now required in many microelectronics applications. See in this respect: Meijer and others: "A New Curvature-Corrected Band-gap Reference"—IEEE Journal of Solid State Circuit, vol. SC-17, No. 6, December 1992.

SUMMARY OF THE INVENTION

An embodiment of the present invention provides a band-gap reference voltage circuit which may be integrated as part of integrated circuits and which provides a temperature compensation on second order effects. The reference voltage circuit enjoys a reduced power consumption.

The reference voltage circuit has a basic structure based on a Brokaw cell that works even when supplied with a low voltage value.

The reference voltage circuit sums together the reference voltage Vbg obtained by the Brokaw cell and a compensation voltage Vcorr to produce a more temperature independent voltage reference.

The new voltage reference is smoother compared to the FIG. 2 voltage curve.

In one embodiment, band-gap voltage reference circuit includes a Brokaw cell for producing a first band-gap voltage reference Vbg; a circuit portion for providing a compensation voltage value Veorr; and circuit means for summing together said compensation voltage value Vcorr and said first band-gap voltage reference Vbg.

The features and advantages of the invention will be appreciated from the following description of a preferred embodiment given by way of non-limiting example with reference to the enclosed drawings.

DETAILED DESCRIPTION

Figure 5:
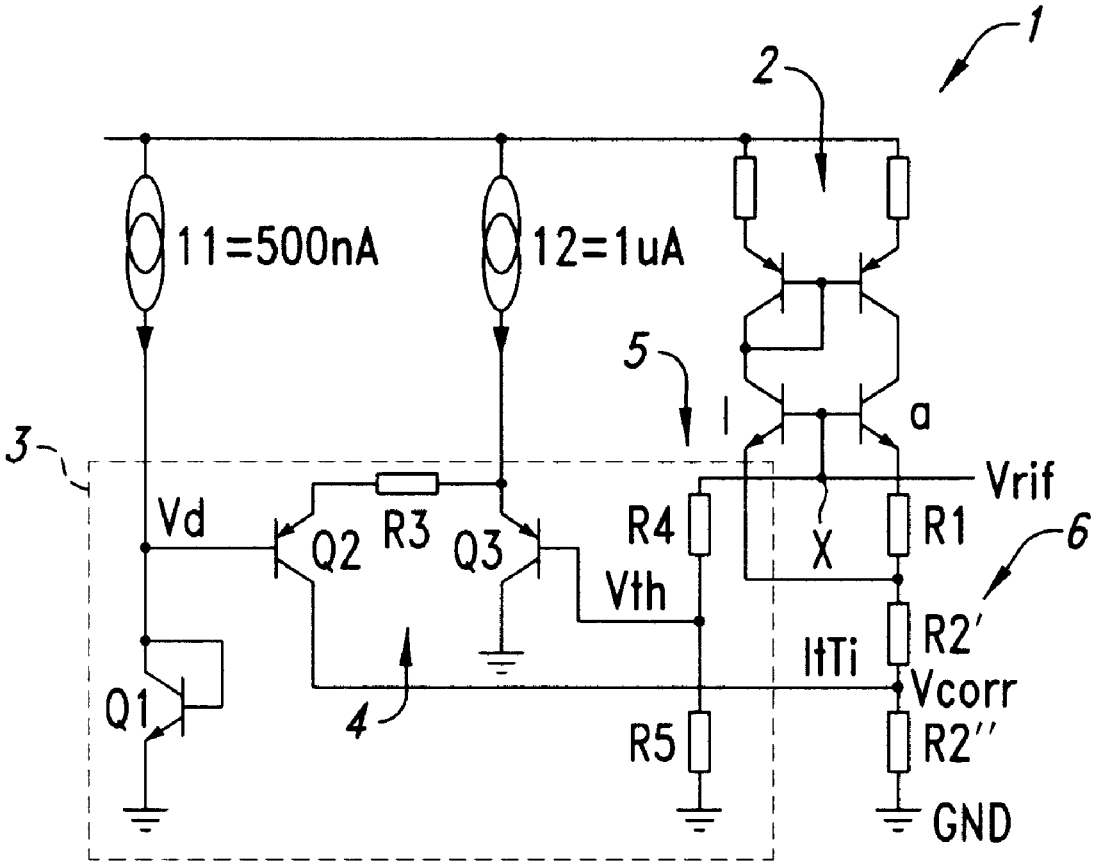
FIG. 5 shows a schematic diagram of a band-gap voltage regulator of FIG. 3 shown in a greater circuit detail.

With reference to the above Figures, and more specifically to the example of FIG. 5, a band-gap voltage regulator circuit according to an embodiment of the present invention is globally indicated with number 1.

Figure 1:
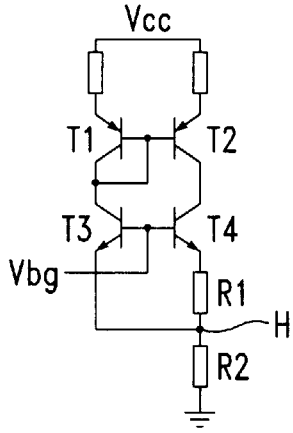
Fig. 1 (Prior Art)
FIG. 1 shows a simplified schematic diagram of a band-gap regulator circuit which is known as a Brokaw cell.
Figure 2:
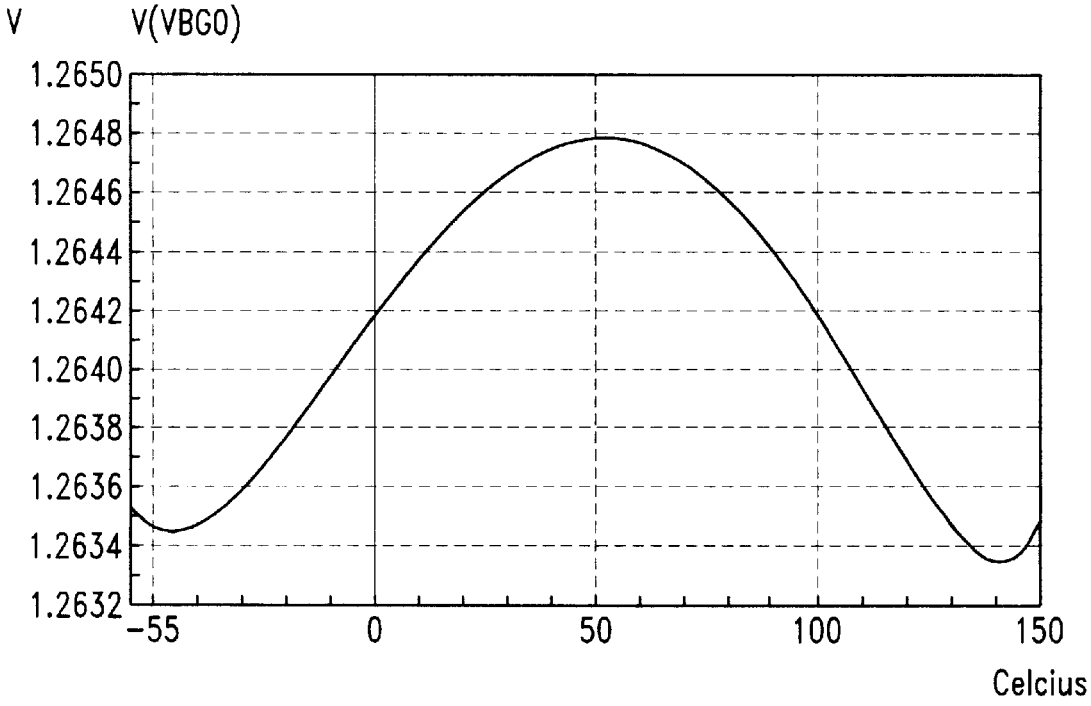
FIG. 2 shows a simplified schematic diagram of a curve of voltage versus temperature of a regulated voltage produced by the Brokaw cell of FIG. 1.

The regulator circuit 1 comprises a band-gap voltage reference generator 2 which is a Brokaw cell of the type previously disclosed with reference to FIG. 1.

The regulator circuit 1 is realized by bipolar technology. However, nothing prevents applying similar principles to other circuit solutions realized by CMOS technology.

The circuit regulator 1 according to the present invention comprises an additional compensation portion 3 which includes a transconductance amplifier 4 and an element which is sensible to temperature variations, for instance a diode connected transistor Q1.

The amplifier 4 is formed preferably by a couple of bipolar transistors Q2 e Q3, both of PNP type. The emitters of those transistors are connected to the supply voltage reference Vcc through a current generator I2. The emitter of the transistor Q2 is connected to the emitter of the transistor Q3 by a resistor R3.

A voltage divider 5, which is formed by a couple of resistances R4, R5, is connected between the interconnection node X between the bases of the transistors T3, T4 of the Brokaw cell 2 and the ground GND.

The transistor Q3 base is directly connected to the interconnection node between the two resistances R4, R5 of the voltage divider 5. The collector of the transistor Q3 is connected to the ground voltage reference GND.

Between the resistor R1 of the Brokaw cell 2 and the GND there is a voltage divider 6 including a first resistance R2' and a second resistance R2". The collector of the transistor Q2 is connected to the interconnection node between those resistances R2' and R".

A current generator I1 is connected to the diode Q1 between the supply voltage reference Vcc and the ground voltage reference GND. The base of the Q2 transistor is connected between the current generator I1 and the diode Q1.

Transistors Q2 and Q3 are the basic structure for the transconductance amplifier 4 which compares the voltage value Vd on the diode Q1, detected by the transistor Q2, with a reference voltage Vth which is taken through the voltage divider 5 from the band-gap voltage Vbg produced by the cell 2 at node X.

On temperature T variations the voltage value Vd decreases and the transistor Q2 starts feeding a current greater than that of the other transistor Q3. The resistor R3 produces a voltage offset so that the transistor Q2 is turned on only after a predetermined temperature value is reached. Moreover, resistor R3 is used also to set up the transconductance value of the amplifier 4.

Figure 4A:
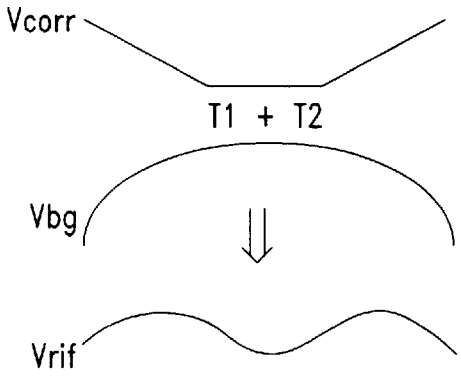
FIG. 4*a* shows respective simplified schematic diagrams of voltage-temperature curves for a first compensation voltage (Vcorr), a first band-gap voltage reference without compensation (Vbg), and for a compensated band-gap voltage (Vrif), respectively.
Figure 4B:
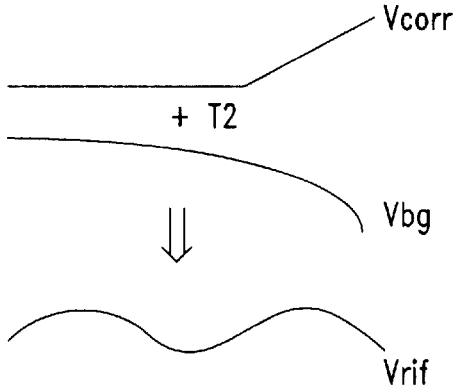
FIG. 4*b* shows respective simplified schematic diagrams of voltage-temperature curves for a second compensation voltage (Vcorr), a second band-gap voltage reference without compensation (Vbg), and for a compensated band-gap voltage (Vrif), respectively.
Figure 4C:
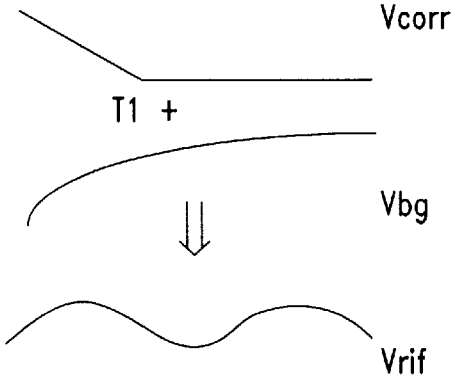
FIG. 4*c* shows respective simplified schematic diagrams of voltage-temperature curves for a third compensation voltage (Vcorr), a third band-gap voltage reference without compensation (Vbg), and for a compensated band-gap voltage (Vrif), respectively.

The operation of the regulator circuit 1 may be better understood making reference to the curvatures voltage-temperature shown in FIGS. 4*a*, 4*b*, and 4*c*.

The regulator circuit 1 is active by summing the band-gap voltage Vbg produced by the Brokaw cell 2 with a compensation voltage Vcorr which allows to obtain more temperature stable voltage reference Vrif.

Just for example, let's suppose to operate in a situation like the one shown in FIG. 4*b*. The compensation voltage Vcorr is generated on the interconnection node between the resistances R2' and R2" of the voltage divider 6.

Such a compensation voltage Vcorr is produced by a current I(T) which is a function of temperature and flows on the resistance R2" and on the connection between such a resistance and the collector of the transistor Q2.

Figure 6A:
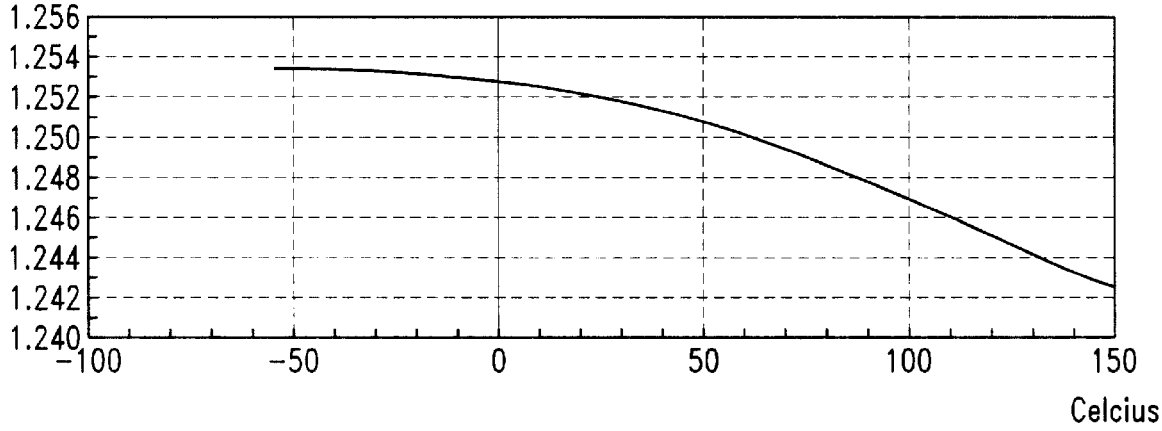
FIGS. 6*a* and 6*b* show simplified schematic diagrams of voltage-temperature curves for a band-gap voltage reference without compensation and for a compensation voltage, respectively.
Figure 6B:
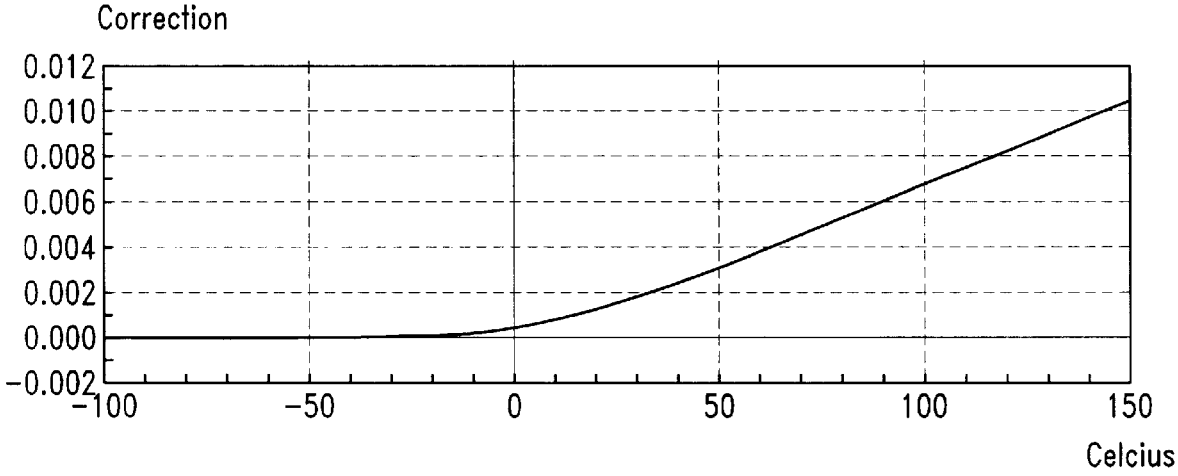

FIG. 6*a* shows the path versus temperature of the band-gap voltage Vbg produced by the Brokaw cell 2. FIG. 6*b* shows the path versus temperature of the compensation voltage Vcorr which is added to the band-gap voltage Vbg by the circuit regulator 1 according to the invention.

If the value of the resistor R3 is chosen appropriately, it's possible to reduce the compensation to zero for temperature values under a predetermined threshold.

Figure 7:
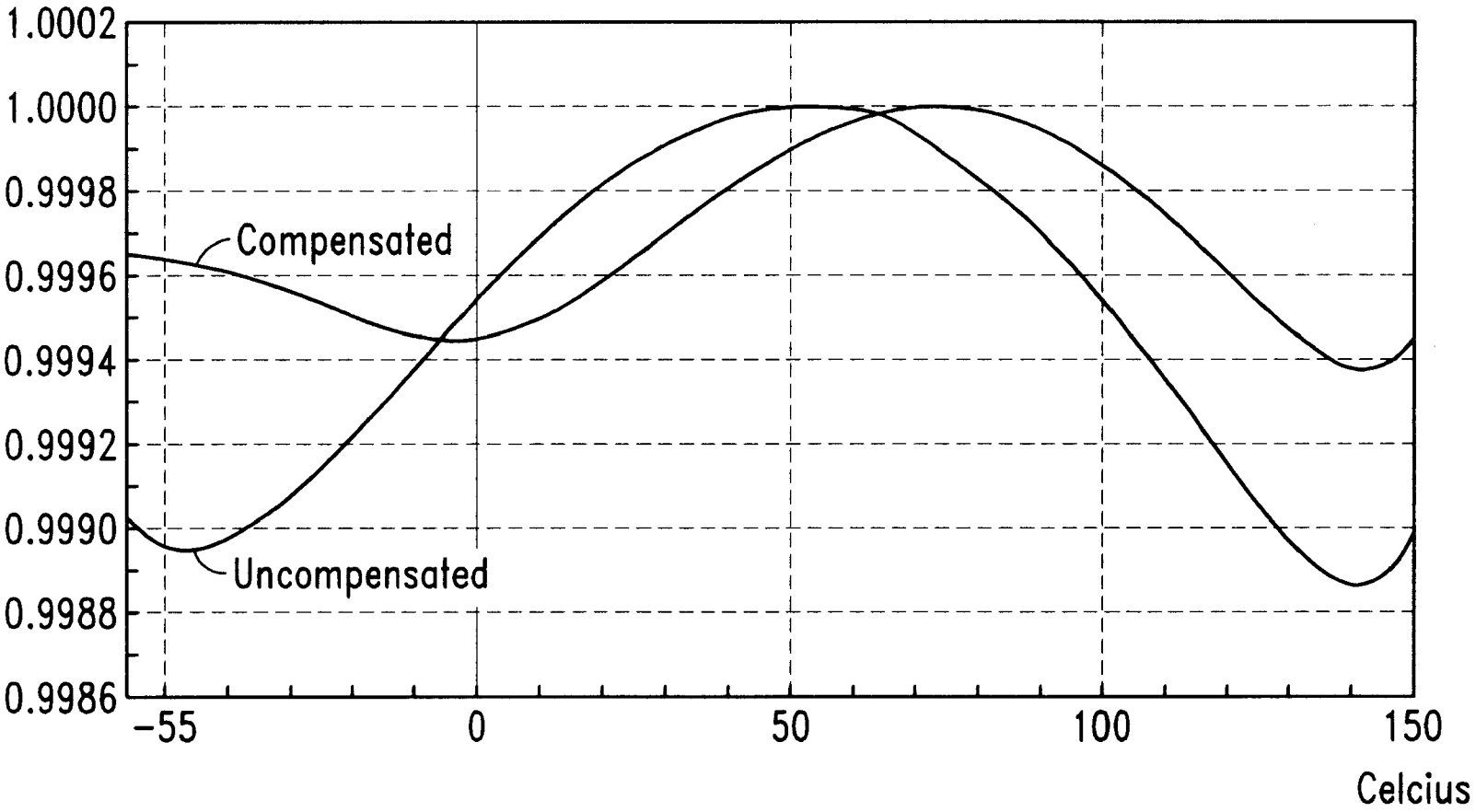
FIG. 7 is a simplified schematic diagram comparing voltage-temperature curves for band-gap voltage references with and without compensation.

From FIG. 7 it may be appreciated a comparison between a compensated band-gap voltage reference Vrif which is obtained by the regulator circuit 1 and a band-gap voltage produced according to the prior art without compensation. As may be clearly observed, the temperature variation of the compensated band-gap voltage reference Vrif is half reduced if compared with the prior art solution, and this with an additional power consumption of only 1.5 $\mu$A.

Figure 3:
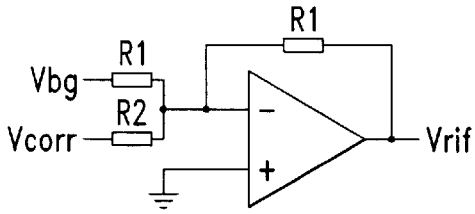
FIG. 3 shows a schematic diagram of a circuit solution according to an embodiment of the present invention.

Therefore, the regulator circuits of FIGS. 3 and 5 obtain various advantages among which the following can be remarked:

a compensation of temperature second order effects on the produced voltage reference;

low power consumption;

the possibility to work even with low supply voltage values.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A band-gap regulator circuit for producing a voltage reference having a temperature compensation on second order effects, comprising:

a Brokaw cell for producing a band-gap voltage reference;

a circuit portion for providing a compensation voltage value: and circuit means for summing together said compensation voltage value and said band-gap voltage reference.

2. The band-gap regulator according to claim 1, wherein said circuit portion includes a comparator connected to an output of the Brokaw cell and receiving on a first input a first voltage value obtained by a partition of said first band-gap voltage reference and on a second input a second voltage value which is a function of temperature to supply at a comparator output said compensation voltage value.

3. The band-gap regulator according to claim 2, wherein said comparator is a transconductance amplifier.

4. The band-gap regulator according to claim 3, wherein the transconductance amplifier has a transconductance value that is regulated by a resistor connected between the comparator inputs.

5. The band-gap regulator according to claim 2, wherein said compensation voltage value is obtained by a temperature dependent current provided at the comparator output.

6. The band-gap regulator according to claim 2, wherein said comparator second input is connected to a temperature sensitive element.

7. The band-gap regulator according to claim 6, wherein said temperature sensitive element is diode connected transistor.

8. The band-gap regulator according to claim 2, wherein said comparator includes a couple of bipolar transistors which are interconnected to form a transconductance amplifier and are supplied through a current generator.

9. The band-gap regulator according to claim 8, wherein an offset resistor is provided between emitters of said bipolar transistors.

10. The band-gap regulator according to claim 2, wherein said circuit means comprises a voltage divider connected to the comparator output and to a transistor of the Brokaw cell.

11. A band-gap regulator circuit for producing a temperature-compensated voltage reference, the regulator circuit comprising:

a current mirror having first and second legs each coupled at a first reference node to a first voltage reference, the first leg including a first transistor with a conduction terminal and a control terminal at which the temperature-compensated voltage reference is produced and the second leg including a second transistor with a conduction terminal and a control terminal coupled to the control terminal of the first transistor;

a first resistance coupled between the conduction terminals of the first and second transistors;

second and third resistances; and a comparator having a first input coupled to a temperature-sensitive second voltage reference, a second input coupled to the control terminals of the first and second transistors by the second resistance, and an output coupled to the conduction terminal of the first transistor by the third resistance.

12. The regulator circuit of claim 11 wherein the comparator includes:

a third transistor having a control terminal corresponding to the first input of the comparator, a first conduction terminal, and a second conduction terminal corresponding to the output of the comparator; and a fourth transistor having a control terminal corresponding to the second input of the comparator, a first conduction terminal coupled to the first conduction terminal of the third transistor, and a second conduction terminal coupled to a third voltage reference.

13. The regulator circuit of claim 12 wherein the comparator further includes a fourth resistance coupled between the respective first conduction terminals of the third and fourth transistors.

14. The regulator circuit of claim 11 wherein the second resistance is part of a voltage divider that includes a fourth resistance coupled between the second input of the comparator and a third voltage reference.

15. The regulator circuit of claim 11 wherein the third resistance is part of a voltage divider that includes a fourth resistance coupled between the output of the comparator and a third voltage reference.

16. The regulator circuit of claim 11 wherein the current mirror and the first and third resistances comprises a Brokaw cell.

17. The regulator circuit of claim 11, further including a diode-connected transistor coupled between the first input of the comparator and a third voltage reference.

18. A method for producing a temperature-compensated band-gap voltage reference, the method comprising:

producing a temperature-sensitive band-gap voltage reference using a Brokaw cell;

producing a compensation voltage that is inversely related to the temperature-sensitive band-gap voltage reference; and summing together the compensation voltage value and the temperature-sensitive band-gap voltage reference.

19. The method of claim 18 wherein the act of producing the compensation voltage includes comparing a temperature-sensitive first voltage reference with a second voltage reference coupled to the band-gap voltage reference with the compensation voltage resulting from the comparison.

* * * * *